US009895593B2

(12) United States Patent
Maier

(10) Patent No.: US 9,895,593 B2
(45) Date of Patent: Feb. 20, 2018

(54) CYCLING SUIT WITH A SEAT PAD AND A METHOD FOR MAKING THE SAME

(71) Applicant: ASSOS OF SWITZERLAND S.A., San Pietro di Stabio (CH)

(72) Inventor: Roger Maier, Carona (CH)

(73) Assignee: ASSOS OF SWITZERLAND GMBH, San Pietro di Stabio (CH)

( * ) Notice: Subject to any disclaimer, the term of this patent is extended or adjusted under 35 U.S.C. 154(b) by 232 days.

(21) Appl. No.: 14/302,524

(22) Filed: Jun. 12, 2014

(65) Prior Publication Data

US 2014/0366254 A1 Dec. 18, 2014

(30) Foreign Application Priority Data

Jun. 18, 2013 (EP) ..... 13172437

(51) Int. Cl.

| | |
|---|---|
| ***A63B 71/12*** | (2006.01) |
| ***A41D 13/00*** | (2006.01) |
| ***A41D 13/015*** | (2006.01) |
| ***A41D 1/08*** | (2018.01) |

(52) U.S. Cl.

CPC ..... *A63B 71/1216* (2013.01); *A41D 1/084* (2013.01)

(58) Field of Classification Search

CPC . A41D 1/06; A41D 1/08; A41D 1/086; A41D 1/088; A41D 1/084

See application file for complete search history.

(56) References Cited

U.S. PATENT DOCUMENTS

| | | | | |
|---|---|---|---|---|
| 3,486,507 | A * | 12/1969 | Arnold | A41B 9/04 2/401 |
| 5,152,014 | A * | 10/1992 | Marx | A41B 9/00 2/228 |
| 2005/0009446 | A1 | 1/2005 | Arnold | |
| 2007/0294803 | A1 | 12/2007 | Furgerson et al. | |

FOREIGN PATENT DOCUMENTS

| | | |
|---|---|---|
| EP | 0643929 | 3/1995 |
| EP | 2494878 | 9/2012 |

* cited by examiner

*Primary Examiner* — Anna Kinsaul

(74) *Attorney, Agent, or Firm* — Fox Rothschild LLP

(57) ABSTRACT

A cycling suit (1) includes a seat pad (2) in the crotch area, and a plurality of fabric panels, which are associated along structural seams, and the seat pad is attached by means of a fabric panel (7) disposed to connect the rear part of said seat pad (2) to the suit (1), and said panel is fixed to the suit along lower back structural seams (8, 9) of the same. A corresponding method for manufacturing the cycling suit is also described.

6 Claims, 2 Drawing Sheets

CYCLING SUIT WITH A SEAT PAD AND A METHOD FOR MAKING THE SAME

CROSS REFERENCE TO RELATED APPLICATIONS

This US Application claims priority to European Application No.: 13172437, filed Jun. 18, 2013, entitled "A CYCLING SUIT WITH A SEAT PAD AND A METHOD FOR MAKING THE SAME" the entirety of which is incorporated herein by reference.

FIELD OF THE INVENTION

The invention relates to the field of cycling sport suits including a seat pad in the crotch area. More in particular, the invention relates to the junction between the seat pad and the suit.

PRIOR ART

Cycling suits including a seat pad are well known in the art.

The suit, according to a known structure, is composed of a plurality of fabric portions connected each other by suitable seams. Said fabric portions of the cycling suit are also termed panels. A cycling garment with such a structure is described in EP-A-1834532.

The seat pad usually comprises a soft fabric piece, which is also termed cover, and a padding. The padding is normally in the form of two or more shaped pads fixed to said cover or, less frequently, to the cycling suit.

The cover normally includes multiple layers, for example a soft expanded material sandwiched between two fabric layers.

According to the known art, the seat pad is fixed to the suit by a seaming or fixing in another way (e.g. gluing, welding) the edge of the cover, or at least a part thereof, to the cycling suit.

It should be noted that the crotch area of the suit, and the seam between the seat pad and the suit, are of crucial importance in a cycling garment, especially when designed for high performance. In particular, the crotch area of the suit undergoes a relevant mechanical stress due to pedalling, and especially the connection between the seat pad and the suit is a most stressed point of the suit.

To date, various improvements to the fixation of the seat pad have been proposed in the art, to enhance performance and comfort. For example, EP-A-1430797 discloses that the lining of a seat pad is attached to cycling shorts at selected points along the edge of the lining; EP-A-2494878 discloses to attach the seat pad along a front attachment region and a rear attachment region, leaving a loose central portion.

However, despite the above efforts, there is a continuous demand for improvement.

SUMMARY OF THE INVENTION

In a cycling suit having the above mentioned structure, namely made of several fabric portions connected each other by perimeter seams, it is proposed to provide the seat pad with a specific rear panel for fixation to the suit. A part of said rear panel is fixed to the seat pad, and another part of said rear panel is fixed to the suit. Additionally, the invention uses existing structural seams of the suit for the anchorage of said rear panel. More in particular, the rear part of the seat pad can be fixed to two lower back seams of the suit, by means of the aforementioned panel.

The aims of the invention are then reached with a cycling suit comprising a seat pad in the crotch area, and a plurality of fabric panels which are associated along structural seam lines, wherein the seat pad comprises a cover and one or more pads, and:

the suit comprises a rear connection panel disposed to attach the rear part of said seat pad to the suit, said rear connection panel is fixed to the suit along at least two of said structural seam lines, connecting together two of said fabric panels of the cycling suit and said rear panel of the seat pad.

In this description and in the attached claims, the term of seam line, or seam, are used to denote any applicable technique for joining fabric panels, including for example sewing, gluing, welding. Preferably, the seam is made by sewing. The term of cycling suit is used to denote various items including at least a trouser portion having a crotch area, such as a bodysuit, a pair of trousers and the like.

Said two structural seam lines, which connect said two panels of the suit and the rear panel of the seat pad, are preferably located in the lower back region of the cycling suit. In a preferred embodiment, they are symmetrically inclined with respect to a median crotch line of the cycling suit.

In a preferred embodiment, an edge of said rear panel is folded over the seam, in such a way that the seam is covered by the edge of the panel. This feature provides some additional advantages, as will be explained below.

Said rear panel is preferably a fabric panel. It is preferably a single layer piece of fabric, while the cover of the seat pad, as above mentioned, is normally made of a plurality of layers, for example three layers including a foam expanded material sandwiched between two fabric layers.

Preferably, said rear panel is substantially triangular, with a base facing the seat pad and a vertex directed towards the back of the suit.

Thanks to the invention, it can be said that the rear part of the seat pad is directly incorporated into structural seams of the cycling suit, for example the lower back seams.

A first advantage of the invention is a better distribution of the mechanical stress in the crotch area and at the interface between the seat pad and the suit. In fact, the novel connection panel distributes the stress in a more uniform way, compared to prior art solutions, for example compared to those solutions where a three-layered cover is directly sewn to the suit.

Another advantage is that the rear connection panel provides an additional protection against sweat in the middle-rear crotch area of the suit, which is a region of intense sweating and scarce ventilation. In a prior art suit, the fabric of the suit is directly exposed to the attack of the sweat, while thanks to the invention the rear connection panel provides an additional means for absorption of the sweat and keeps the panels of the suit from direct attack of the sweat.

Another advantage is that the number of seams during the manufacturing process can be reduced. It should be noted that, in most cases, the manufacturer of the cycling suit receives the seat pad from an external supplier, ready to insertion in the suit. According to the prior technique, the manufacturer of the cycling suit must perform separate seams to connect together the panels of the suit, and then to attach the seat pad. In contrast, the invention provides that the seat pad is supplied with the additional rear panel and can be attached to the suit during the execution of the two lower back seams. Accordingly, the work of the manufacturer is reduced.

The preferred embodiments including the rear panel folded over the seams has some additional advantages. First, the skin of the user is kept from a direct contact and friction with the seams, which may be a source of discomfort particularly in the crotch area where skin is highly sensitive; secondly, the seams are even better protected from the aggression of sweat during intensive use.

Still another advantage of the invention is a better adherence and a better approach to the ideal behaviour of the suit as a second skin.

An aspect of the invention is also a method for making a cycling suit, according to the attached claims.

The features and the advantages of the invention will be further elucidated with the help of the following detailed description, which is given for indicative and not limiting purpose.

DETAILED DESCRIPTION

A cycling suit 1 includes a seat pad 2 in the crotch area. The cycling suit 1 is made of a suitable elastic fabric, such as Lycra, and may have different forms, such as a bodysuit, a pair of trousers, and others, according to various embodiments of the invention and the intended use, e.g. winter or summer, male or female, etc.

The cycling suit 1 is made preferably with an elastic woven or knitted fabric, and comprises several fabric panels, joined together along suitable perimeter seams or equivalent.

Figure 2:
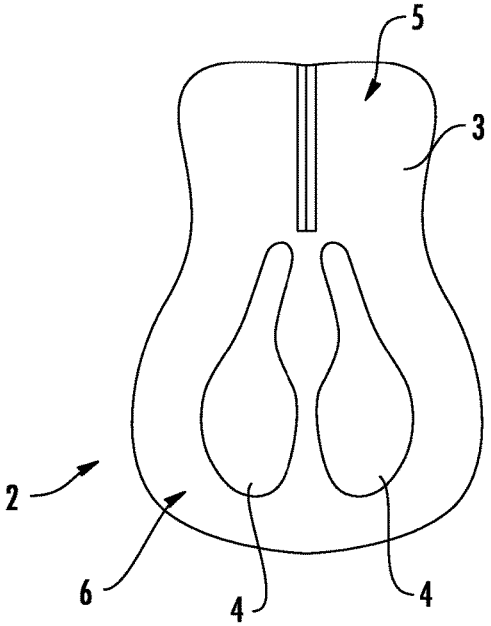
FIG. 2 is a top view of the seat pad of the cycling suit of FIG. 1.

The seat pad 2 includes a soft fabric piece to form a cover 3, and a suitable padding which for example includes a couple of pads 4. FIG. 2 illustrates and example of an anatomical shape of the seat pad 2, having a front portion 5 and a rear portion 6.

Figure 3:
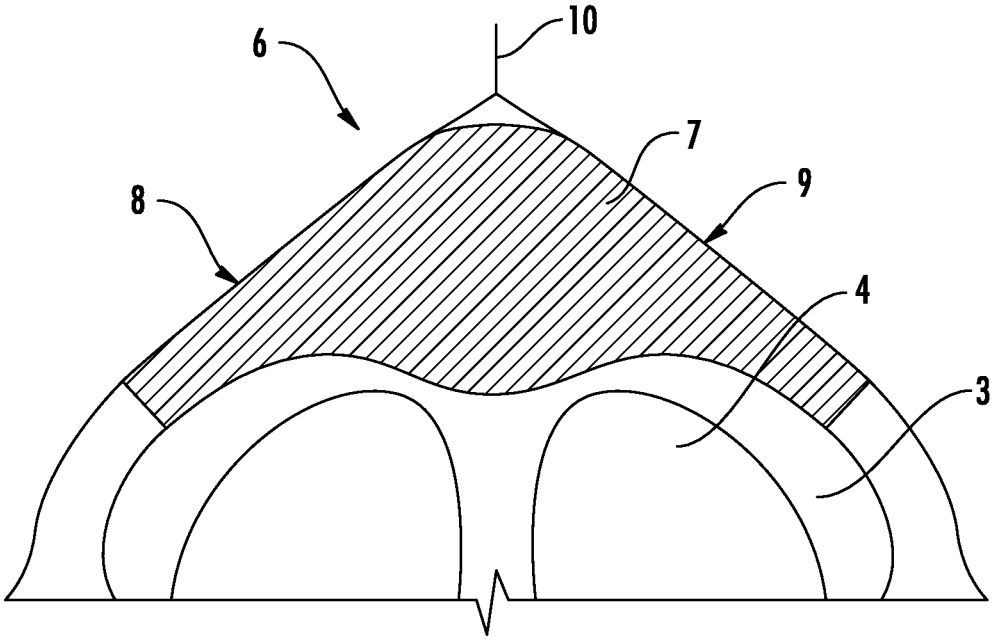
FIG. 3 is a detail of the connection between the seat pad and the cycling suit.

A detail of the connection to the cycling suit, according to an embodiment of the invention, is depicted in FIG. 3.

The seat pad 2 is attached to the suit 1 via a rear connection panel 7, which in this example is embodied as a fabric panel, for example made in part of Lycra. Said panel is fixed to the suit 1 along two seams 8 and 9. Said seams 8 and 9 are also the lower back seams of the suit 1, which means that each seam 8 or 9, respectively, joins together two of the fabric portions which form the cycling suit 1.

Figure 1:
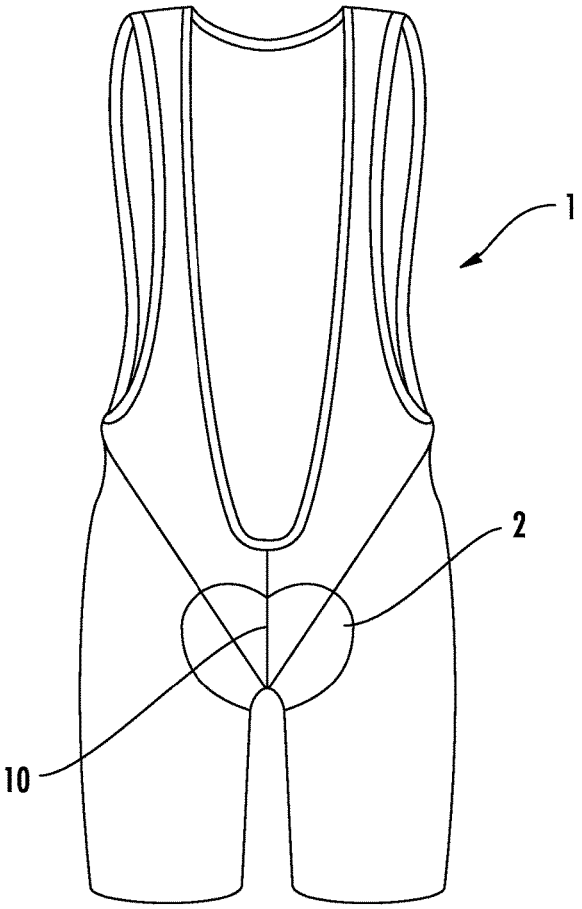
FIG. 1 is a view of a cycling suit according to an embodiment of the invention, comprising a seat pad in the crotch area.

Said seams 8 and 9 are symmetrically inclined with respect to a median crotch line 10 of the cycling suit 1, which is indicated in FIG. 1 and FIG. 3.

Figure 4:
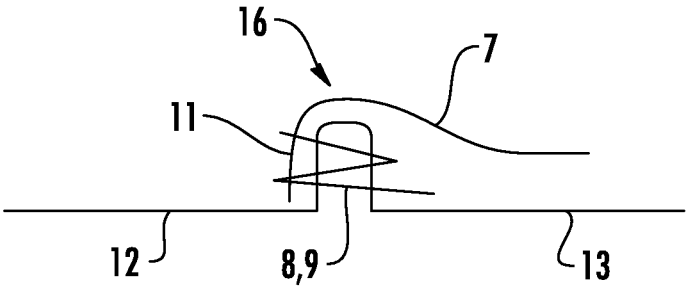
FIG. 4 is a scheme of a preferred embodiment for a junction between the seat pad and the cycling suit.

FIG. 4 shows a preferred embodiment where an edge portion 11 of the panel 6 is folded over the respective seam 8 or 9, which connects two panels 12, 13 of the suit 1 forming an overall junction line 14. It can be seen that the seam 8 or 9 is covered by the edge 11. Accordingly, the user is kept from direct contact with the seam, which may be a source of discomfort, and the panels 12, 13 are not directly exposed to the attack of the sweat which is particularly severe in this region of the suit.

The invention meets the aforesaid scopes, providing a perfect integration between the seat pad and the suit, a better comfort and performance.

The invention claimed is:

1. A cycling suit (1) comprising a seat pad (2) in the crotch area, wherein the cycling suit comprises a plurality of fabric panels, which are associated along structural seam lines, and the seat pad comprises a cover (3) and two pads (4), the cover (3) comprising a foam expanded layer sandwiched between two fabric layers and the two pads (4) being longitudinally arranged symmetrical around a longitudinal axis of the cover, characterized in that: the suit (1) comprises a rear connection panel (7) in addition to the plurality of fabric panels, the rear connection panel (7) disposed to attach the rear part (6) of said seat pad (2) to the suit (1), and said rear connection panel (7) having two sides which converge to a median line (10) following two lines of fixation to the suit, said lines of fixation corresponding to two of said structural seam lines (8, 9), connecting together two (12, 13) of said fabric panels of the cycling suit (1) and said rear connection panel (7).

2. A cycling suit according to claim 1, wherein said two seam lines (8, 9) are located in the lower back region of the cycling suit.

3. A cycling suit according to claim 2, wherein said two seam lines are symmetrically arranged and inclined with respect to a median crotch line (10) of the cycling suit.

4. A cycling suit according to claim 1, wherein an edge (11) of said connection panel (7) is folded over said structural seam lines (8, 9), in such a way that said edge of the panel covers said seam lines.

5. A cycling suit according to claim 1, wherein said connection panel (7) is substantially triangular.

6. A cycling suit according to claim 1, wherein said connection panel (7) is made with a single layer piece of fabric.

* * * * *